United States Patent [19]

Littlewood

[11] 4,157,824

[45] Jun. 12, 1979

[54] FABRIC WORK PIECE SEPARATOR

[75] Inventor: Kenneth J. Littlewood, Carlton, Australia

[73] Assignee: K. J. Littlewood Pty. Ltd., Carlton, Australia

[21] Appl. No.: 791,555

[22] Filed: Apr. 27, 1977

[30] Foreign Application Priority Data

Apr. 28, 1976 [AU] Australia ..... 5730/76
Apr. 26, 1977 [AU] Australia ..... 24576/77

[51] Int. Cl.[2] ..... B65H 3/22

[52] U.S. Cl. ..... 271/10; 271/18.3; 271/19; 414/120

[58] Field of Search ..... 271/18.3, 19, 20, 21, 271/22, 23, 24, 25, 10, 16, 17; 214/8.5 C, 8.5 SS

[56] References Cited

U.S. PATENT DOCUMENTS

| | | | |
|---|---|---|---|
| 1,225,740 | 5/1917 | Anderson | 271/19 |
| 3,353,821 | 11/1967 | Smith et al. | 271/22 X |
| 3,442,505 | 5/1969 | Szentkuti | 271/21 X |
| 3,940,125 | 2/1976 | Morton | 271/18.3 X |
| 4,009,786 | 3/1977 | Littlewood | 271/18.3 X |

*Primary Examiner*—Bruce H. Stoner, Jr.
*Attorney, Agent, or Firm*—Joseph G. Denny, III; Peter J. Patane

[57] ABSTRACT

An apparatus for separating a top ply from a stack of fabric workpieces before removal and depositing the ply at a processing location. The apparatus comprises an air cylinder actuator connected to a friction pad for engaging the top ply, the pad being mounted in a guide member for movement with an impacting force, on application of a pulse of pressure air to the air cylinder, to displace the top ply in a sweeping and lifting action from and across the stack while the guide member is forced downwardly into engagement with the remaining plies in the stack to hold the stack against movement as the displaced ply is removed.

4 Claims, 6 Drawing Figures

FABRIC WORK PIECE SEPARATOR

BACKGROUND OF THE INVENTION

This invention relates to a method of and apparatus for handling and separating limp fabric pieces and in particular to an apparatus which may be used in manual pickup operations or in combination with a pick-up device of the type described in my prior U.S. Pat. No. 4,009,786 or other similar devices adapted to feed, transfer and stack limp fabric work pieces to and through automatic or semiautomatic process machines such as, for example, garment processing machines.

The manufacture of clothing and other products from cloth or like flexible sheet material can be achieved by sewing and other processes applied to pre-cut work pieces usually delivered in stacks to the processing machines. The manufacture of other articles such as drapery, footwear, soft furnishings, auto seat covers and trims, and the like can also be achieved from assemblies of sewn or bonded pieces cut from webs of material. Normally, the productivity of the industries manufacturing these products is limited by the ability of operators to pick up and gain control of the individual pieces and present them in matched assemblies to adjustable process machines.

Process machines are available which are designed to perform particular operational functions such as control of the direction of sewing, positioning of work pieces, machine stop/start and other known desired functions in the manufacture of an article from fabric or like flexible material.

In order to feed these sewing and other machines, various devices have been proposed with the object of gaining control of the material and separating individual pieces from a cut stack of pieces. In the past, methods of operation used for feeding such machines have met with varying degrees of success due to the porosity and handling variables of the material and the comparative limp nature of fabric materials, and difficulties of separation from following pieces in a stack presents additional problems.

Apart from the device of my prior U.S. Pat. No. 4,009,786, a number of devices have been designed in an attempt to solve fabric feeding problems. One type of known device relies upon adhesion to a sticky surface; another utilized inwardly closing prongs in the manner of a chuck; another uses high frictional surfaces to pinch the surface ply; another uses the uniformly angularly oriented needles of card cloth for unidirectional frictional contact and pickoff; and yet another uses air suction members. Having gained control of the top piece of cloth, various means have been used to separate the piece without displacement of the other pieces in a stack, since any such movement would spoil the accuracy of engagement of the subsequent pieces and thus positioning would be inaccurate.

These devices have proved successful with a limited range of fabrics but have not solved the problems associated with the separation of woven or knitted cloth work pieces wherein the hairy surfaces of such cloths entangle and form a strong bond between pairs of plies in a stack. This is particularly so in the case of circular knit tubular cloths and in other cases edge threads become entangled or thermoplastic yarns may be fused together when the fabric pieces are cut from a stack.

Unsuccessful attempts have been made to overcome the above-atated problems including the application of suction to the stack or the engaging and lifting of an edge of the top ply and the insertion of a thin rigid plate which latter method is not reliable as plies bonded in pairs present an unsupported ply which distorts and is not accessible.

It is an object of the invention to provide positive effective means to firstly separate strongly bonded plies in a stack, even when bonded in pairs, then firmly grip the second ply of the stack and thereafter positively engage the top ply and peel it from the second retained ply.

A further object of the invention is to provide a method and apparatus which maintains control of a stack of plies so as to prevent the stack from "walking" or being displaced during the fabric separating and feeding cycles.

Yet another object of the invention is to retain the cut portions of the top plies as the deep soft stacks are mechanically elevated during the feeding process. It has been found that maintaining stack alignment is a major problem when working with very soft limp materials in economically viable deep stacks.

SUMMARY OF THE INVENTION

The above objects are achieved by providing an apparatus for separating plies of fabric from a stack, comprising a mounting bracket, fluid cylinder actuating means connected to a source of fluid pressure and pivotally mounted in the mounting bracket and including a piston and actuating rod extending therefrom, friction pad means mounted on the end of the actuating rod for engaging the top ply of the stack, said pad means being located in a guide member for movement from the ply engaging position with an impacting force outwardly and upwardly relative to the fluid cylinder actuating means of a pulse energization of said actuating means so as to separate and displace the top ply in a sweeping and lifting action from and across the stack, and abutment means engageable by said pad means during upward movement thereof so as to move the guide member downwardly into engagement with the remaining plies in the stack and hold same against movement as the displaced ply is removed from the stack.

The fluid cylinder actuating means is preferably located in a block member pivotally mounted in the bracket and the abutment means may comprise a plate member secured to the top of said mounting bracket.

The friction pad means may comprise carding cloth attached to a slide block movable in said guide member in an arcuate fashion on energization of the fluid cylinder actuating means, said assembly of actuating means, guide means and slide block being pivotally balanced in the mounting bracket so as to exert a relatively light pressure on the top of the stack. In order to enhance the free pivotal movement of the said assembly, the source of pressure fluid may be connected to both ends of the fluid cylinder through the mounting bracket and pivotal block member. This obviates any drag that may be applied to the assembly by fluid pressure hoses connected directly to the fluid cylinder.

The separator apparatus of the invention is eminently suitable for use in conjunction with a fabric pick-up device as described in my prior U.S. Pat. No. 4,009,786.

According to a further feature of the invention there is provided a method of transferring a fabric ply from a stack comprising the steps of engaging the separating apparatus of the invention with a stack of plies, engaging the stack with a pick-up transferring device, actuating the separating apparatus to separate and displace the top ply of the stack at one side thereof whilst engaging and holding the remaining plies in the stack, and actuating the pick-up transferring device to lift the separated ply from the stack.

BRIEF DESCRIPTION OF THE DRAWINGS

In order that the invention and its manner of performance may be more fully described reference will now be made to an embodiment of the invention as illustrated in the accompanying drawings in which:-

DESCRIPTION OF THE PREFERRED EMBODIMENT

Figure 1:
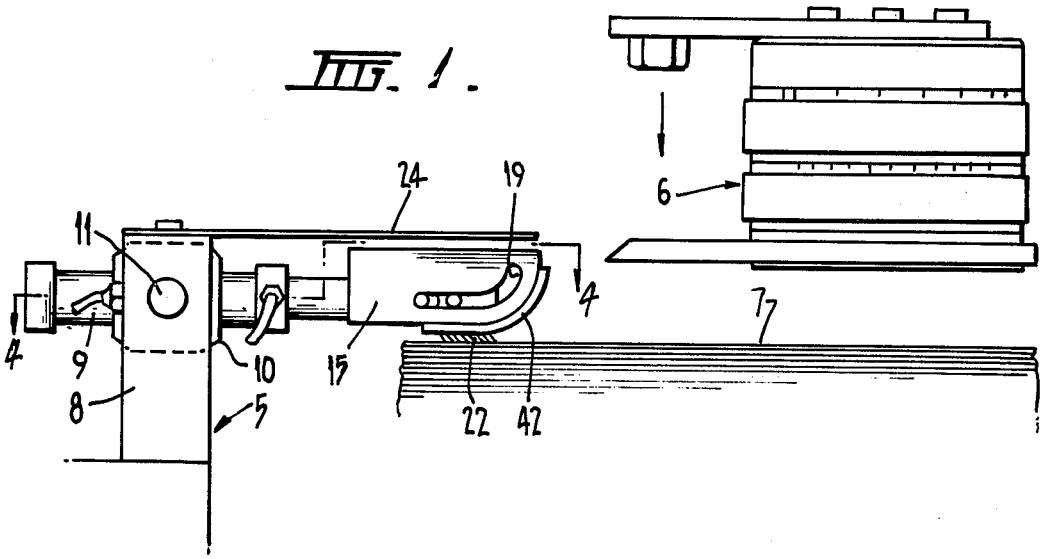
FIGS. 1, 2 and 3 are schematic illustrations of the separator apparatus when used in conjunction with a ply pick-up feeding device.
Figure 2:
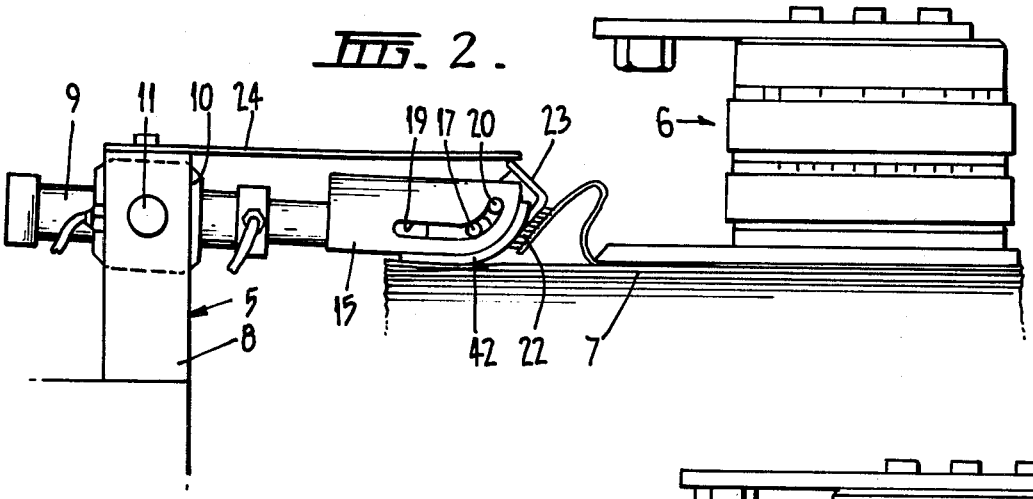
Figure 3:
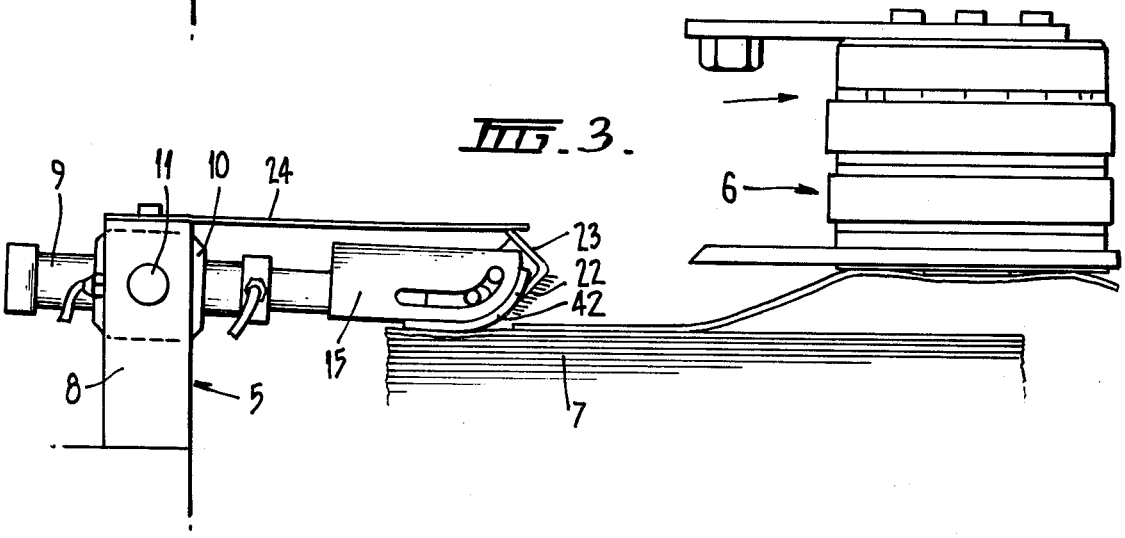

Referring to the drawings, in particular FIGS. 1, 2 and 3, there is shown a separator apparatus 5 of the invention, a pick-up feeding device 6 of the type disclosed in my prior U.S. Pat. No. 4,009,786 and a stack of fabric plies 7 which stack is normally biassed upwardly in a magazine or the like.

Figure 4:
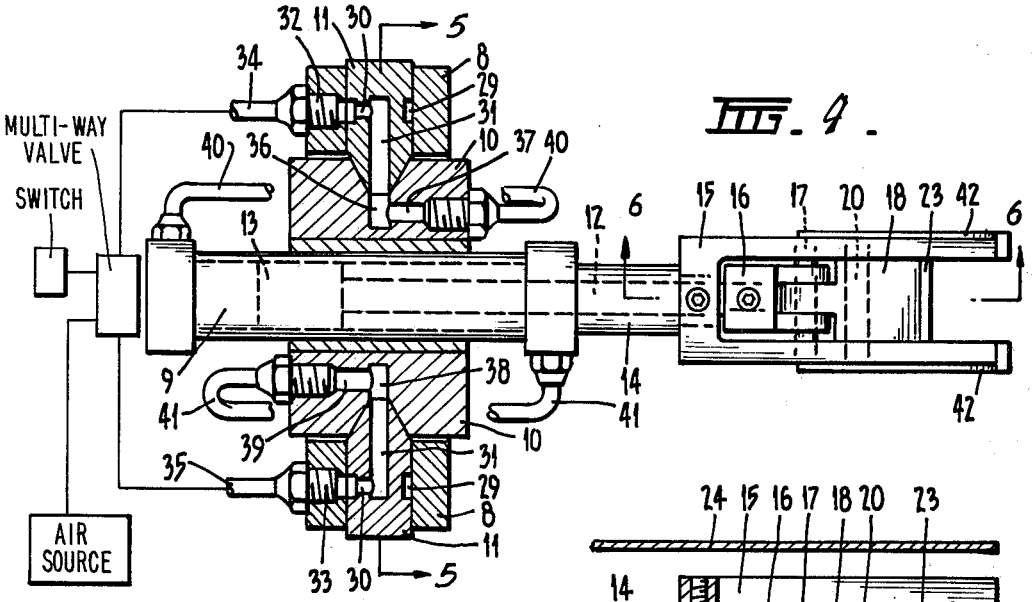
FIG. 4 is a plan view in part-section of the separator apparatus taken along the line 4—4 of FIG. 1.
Figure 6:
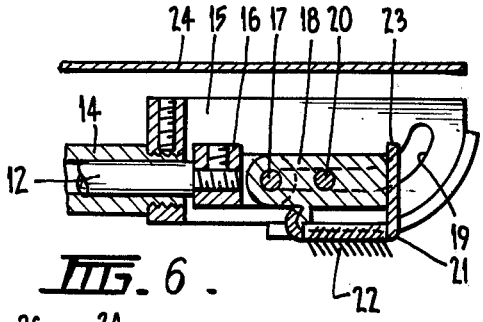
FIG. 6 is a sectional view of a detail of the apparatus taken along the line 6—6 of FIG. 4.
Figure 5:
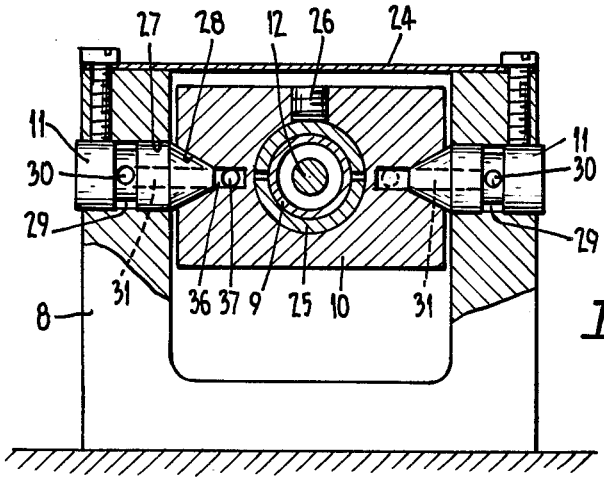
FIG. 5 is an end sectional view taken along the line 5—5 of FIG. 4.

The separator apparatus as shown in greater detail in FIGS. 4, 5 and 6 includes a substantially U-shaped mounting bracket 8, a double-acting air cylinder 9 and a block member 10 mounting the air cylinder 9 to the bracket 8 by means of pivot pins 11. Actuating rod 12 attached to piston 13 extends from cylinder 9 for sliding movement through a bush 14 between guide member 15 and the air cylinder.

Bifurcated slide block member 16 is attached to the outer end of actuating rod 12 and pivotally connected by means of pin 17 to a further slide block 18. Guide member 15 is provided with aligned slots 19 of arcuate configuration at their outer sections and pin 17 extends into said slots 19 to guide slide block 16 for linear movement in the guide member 15. Block 18 is provided with a pin 20 also engageable in slots 19 so as to guide block 18 linearly and upwardly in the arcuate sections of slots 19. A carrier member 21 provided with a carding cloth pad 22 is attached to slide block 18 with one leg 23 extending upwardly on the outer face of block 18 for engagement during actuation of the device (as shown in FIGS. 2 and 3) with an abutment plate 24, as will be hereinafter more fully described.

Air cylinder 9 is clamped in pivot block 10 by means of split bush 25 engaged by locking screw 26 so that the assembly may be readily adjustable in its location in mounting bracket 8 to provide the required degree of pressure on the stack 7. The pressure applied by the carding cloth to the stack should preferably not exceed 2 to 4 ozs. mass in most applications where limp fabric plies are being processed.

Pivot pins 11 extend through aligned holes 27 in mounting bracket 8 and engage in tapered seats 28 in block member 10. Pins 11 are secured in position by suitable locking screws. Pins 11 have an annular groove 29 and passages 30 and 31 connected thereto. Grooves 29 are connected with passages 32 and 33 in mounting bracket 8, said passages 32 and 33 in turn being connected to pressure air hoses 34 and 35 which may be alternately connected to a source of air pressure or to exhaust.

Passages 31 in pivot pins 11 connect with passages 36, 37 and 38, 39 which in turn connect with hoses 40, 41 connected at either end of air cylinder 9.

It will be noted that by leading pressure air to the air cylinder through the mounting bracket and pivot block member, the hoses 40 and 41 move with the pivot block member and air cylinder assembly during tilting or pivoting thereof and exert no drag on the assembly as could be the case if the pressure air hoses were directly connected to the ends of the air cylinder.

At the source of air pressure or exhaust there is provided an air pulse controller or switch and a multi-way valve or valves, said fluid pressure preferably being in the range of 80 to 100 p.s.i. with the pulse controller operable for a period of approximately 500 m. sec.

In operation of the separator apparatus of the illustrated embodiment when used in conjunction with a fabric ply pick-up feeding device 6, FIG. 1 illustrates the carding cloth pad 22 at rest on the top ply of stack 7, being biassed to that position by adjustment of the air cylinder 9 in its mounting blocks 10, so as to exert a light pressure not exceeding 2 to 4 ozs. mass on the stack 7. The pick-up device 6 is located above the stack and is brought into engagement under light pressure with the stack.

The multi-way valve at the air pressure source is in a position allowing no pressure air to hose 34 with hose 35 connected to exhaust. The pulse controller or switch and multi-way valve is then actuated to send a pulse of pressure air through hose 34, passages 32, 30, 31, 36, 37, and hose 40 to one side of piston 13 so as to move actuating rod 12 rapidly outwards causing sliding block 18 to also move outwardly and upwardly in guide member 15 so that a rapid impacting force is delivered through the carding cloth 22 to the fabric ply which is moved linearly with a shearing effect against the under ply in the stack and then upwardly in a sweeping and lifting movement to further separate the top ply from the stack. As the slide block 18 and carding cloth carrier 21 swivel upwardly, leg 23 of carrier 21 strikes abutment plate 24 with a resultant tilting of guide member 15 downwards to firmly engage the under ply of the stack through resilient pads 42 and hold the stack in alignment. As pulse air is delivered to the separator, pressure air is also delivered to the pick-up device 6 to energize its needles or other ply engaging means to firmly engage the top ply for removal from the stack. FIG. 2 illustrates the position of the separator, ply and pick-up device at this stage of the operation.

With the stack firmly held by the guide member 15 the pick-up device 6 is actuated to lift off the top ply and move it to another station as shown in FIG. 3.

After removal of the top ply the multi-way valve at the air pressure source is operated to move piston 13, actuating rod 12 and slide blocks 16 and 18 back to the position shown in FIG. 1 in readiness to commence another cycle.

It will be appreciated that although I have above described the operation of the separator of my invention in conjunction with or complimentary to a ply pick-up device, the separator can be used by itself to separate difficult materials for either manual or mechanical pick-up functions.

Furthermore with a pick-up device of the type disclosed in my prior U.S. Pat. No. 4,009,786 which can be preset to transfer a preselected number of plies at one time, the separator can be re-cycled to separate the desired number of plies before the pick-up device is actuated to remove the separated preselected number of plies from the stack.

I claim:

1. An apparatus for separating plies of fabric from a stack, comprising a mounting bracket, fluid cylinder actuating means connected to a source of fluid pressure and pivotally mounted in the mounting bracket and including a piston and actuating rod extending therefrom, friction pad means mounted on the end of the actuating rod for engaging the top ply of the stack, said pad means being located in a guide member mounted on and extending from said fluid cylinder means for movement from the ply engaging position with an impacting force outwardly and upwardly relative to the fluid cylinder actuating means on a pulse energization of said actuating means so as to separate and displace the top ply in a sweeping and lifting action from and across the stack, and fixed abutment means attached to said mounting bracket and engageable by said pad means during upward movement thereof so as to cause resultant movement of the pivotally mounted guide member downwardly into engagement with the remaining plies in the stack and hold same against movement as the displaced ply is removed from the stack.

2. An apparatus in accordance with claim 1 wherein said friction pad means comprises carding cloth attached to a slide member mounted in guide slots in said guide member, said guide slots extending upwardly and outwardly arcuately in their end sections outermost from said mounting bracket.

3. An apparatus in accordance with claim 2 which further includes a block member pivotally mounted on pivot pins in said mounting bracket, said fluid cylinder actuating means being adjustably mounted in said block member, and wherein said pressure air source is connected through said mounting bracket, pivot pins and block member to either end of said fluid cylinder actuating means.

4. An apparatus in accordance with claim 1 and further including a pick-up device for engaging said stack during separation of the top ply and removing same thereafter.

* * * * *